US007494755B2

(12) United States Patent
Vanbesien et al.

(10) Patent No.: US 7,494,755 B2
(45) Date of Patent: Feb. 24, 2009

(54) TONER COMPOSITION AND METHOD

(75) Inventors: Daryl W. Vanbesien, Burlington (CA); Jennifer Lynne Belelie, Oakville (CA); Peter Gordon Odell, Mississauga (CA); Christine Deborah Anderson, Hamilton (CA); Cuong Vong, Hamilton (CA); David J. Sanders, Oakville (CA); Aleksey Tabachnik, Vaughn (CA)

(73) Assignee: Xerox Corporation, Norwalk, CT (US)

( * ) Notice: Subject to any disclaimer, the term of this patent is extended or adjusted under 35 U.S.C. 154(b) by 519 days.

(21) Appl. No.: 11/289,375

(22) Filed: Nov. 30, 2005

(65) Prior Publication Data

US 2007/0122728 A1 May 31, 2007

(51) Int. Cl.
*G03G 9/00* (2006.01)

(52) U.S. Cl. ..... 430/108.1; 430/109.1; 430/109.3; 399/252

(58) Field of Classification Search ..... 430/108.1, 430/109.1, 109.3; 399/252
See application file for complete search history.

(56) References Cited

U.S. PATENT DOCUMENTS

| | | | | |
|---|---|---|---|---|
| 5,470,683 | A | 11/1995 | Inaishi | |
| 5,905,012 | A | 5/1999 | De Meutter et al. | |
| 6,713,222 | B2 | 3/2004 | Sacripante et al. | |
| 7,250,238 | B2 * | 7/2007 | Fromm et al. | 430/110.2 |
| 2005/0137278 | A1 | 6/2005 | Fromm et al. | |

FOREIGN PATENT DOCUMENTS

| | | |
|---|---|---|
| EP | 0 821 281 | 1/1998 |
| EP | 1 174 401 | 1/2002 |
| EP | 1 437 628 | 7/2004 |

* cited by examiner

*Primary Examiner*—Mark A Chapman
(74) *Attorney, Agent, or Firm*—Oliff & Berridge, PLC; Eugene O. Palazzo

(57) ABSTRACT

A method for forming toner particles includes polymerizing monomers to form a latex comprising polymer particles; combining the latex with unsaturated curable resin to form aggregates containing the polymer particles and the unsaturated curable resin particles; and heating the aggregates to form coalesced particles. A toner composition that may be formed by the process described herein contains toner particles containing polymer containing photoinitiator and unsaturated curable resin. Another toner composition that may be formed by the process described herein contains toner particles containing unsaturated curable resin and, on the surface of the toner particles, photoinitiator.

14 Claims, No Drawings

TONER COMPOSITION AND METHOD

TECHNICAL FIELD

The present disclosure relates to toner, particularly toner made by emulsion aggregation, containing an unsaturated curable resin, and to methods for forming and using such toner.

BACKGROUND

The electrostatographic process, and particularly the xerographic process, is known. This process involves the formation of an electrostatic latent image on a photoreceptor, followed by development of the image with a developer, and subsequent transfer of the image to a suitable substrate. In xerography, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles, called toner, on the surface of the photoconductive insulating layer. The resulting visible image may then be transferred from the imaging member directly or indirectly (such as by a transfer or other member) to a recording medium, such as transparency or paper. The imaging process may be repeated many times with reusable imaging members.

A current trend in the printing industry is printing on stress case media, such as flexible packaging and automobile owner manuals. The flexible packaging industry includes packaging of food, pharmaceuticals, cosmetics, etc. The stress case of automobile owner manuals involves the image permanence at elevated temperatures for example, in a glove box of an automobile on a hot summer day.

Printing on stress case media can require the use of materials that are durable and that are resistant to a variety of conditions and environmental factors. Many offset printings use a heated overcoat to protect the image from abrasion. However, overcoats applied to fused and unfused images can cause degradation of image quality. Accordingly, there is a desire for a toner composition that in embodiments may not require a protective overcoat.

Furthermore, in the graphic arts industry and for a number of other entities, printing is performed on a wide array of substrates and surfaces such as on yogurt containers, foil seals for containers and other diverse packaging configurations. There can be a number of disadvantages associated with using heat fused xerographic toners in these traditionally lithographic printing applications. Many lithographic applications use an overcoat that is subsequently heated to protect images from abrasion. However, applying overcoats to fused and unfused toner can disturb the toner piles. Overcoats are usually applied with heat and this heat causes dry toners to smear and possibly undergo phase separation that can damage image quality. Accordingly, there is also a desire for a single application printing process that can avoid the need for an overcoat, and particularly can avoid a process that includes applying and heating an overcoat.

In addition, obtaining a toner formulation with low melt characteristics is desired to reduce operation costs. However, a toner with low melt characteristics often has bad offset properties. Thus, it would be desirable to provide a toner composition that is fusible with reduced heating.

REFERENCES

U.S. Pat. No. 5,470,683 describes a photosensitive microcapsule toner encapsulating a photocurable composition composed of a radical polymerizable unsaturated group-bearing compound, a metal arene compound as a polymerization initiator, a spectral sensitizing dye, and a color material.

U.S. Pat. No. 6,713,222 describes a process for crosslinking an image comprising applying ultraviolet light to an image comprised of a toner containing an unsaturated resin and colorant.

U.S. Pat. No. 5,905,012 (hereinafter "the 012 patent") describes toner particles comprising radiation curable compounds having a glass transition temperature ≧35° C. Specifically, the 012 patent describes that the resin is an unsaturated polyester/polyurethaneacrylate mixture or an unsaturated polyester/polyurethane-vinylether mixture. The 012 patent indicates that the composition may further comprise a photoinitiator. In addition, the 012 patent indicates that the toner particles can be prepared by any method known in the art. As examples, the 012 patent describes that "emulsion polymerisation" and "polymer emulsion" techniques may be used for toner preparation.

U.S. Published Application No. US 2005/0137278 A1 (hereinafter "the 278 application") describes UV curable toner compositions. To form these toner compositions, the 278 application describes preparing a latex of a polymer formed from styrene, butyl acrylate, 2-carboxymethyl acrylate, and a UV curable acrylate; combining the latex with an optional pigment and an optional wax to form a first system; adding flocculant to the first system to induce aggregation and form toner precursor particles dispersed in a second system; and heating the toner precursor particles to a temperature greater than the glass transition temperature of the polymer to form toner particles. ¶[0009].

In another embodiment, the 278 application describes a method comprising mixing a latex of a polymer formed from styrene, butyl acrylate, and carboxymethyl acrylate, with pigment and wax to form a first system; adding flocculant to the first system to induce aggregation and form toner precursor particles dispersed in a second system; adding a UV curable acrylate to the second system to form a shell on the toner precursor particles; and heating the toner precursor particles to a temperature greater than the glass transition temperature $T_g$ of the shell to form toner particles. ¶[0011].

The 278 application describes that the toner composition optionally also includes an effective amount of a photoinitiator, which upon being exposed to ultraviolet light, causes the toner to substantially immediately polymerize. ¶[0021]. In the examples, the 278 application describes adding the photoinitiator during formation of a latex. ¶¶[0058], [0060] and [0062].

The disclosures of each of the foregoing U.S. Patent documents are hereby incorporated by reference herein in their entireties. The appropriate components and process aspects of the each of the foregoing U.S. Patent documents may also be selected for the present compositions and processes in embodiments thereof.

SUMMARY

The present disclosure describes techniques by which an unsaturated curable resin and/or photoinitiator can be incorporated into emulsion aggregation toner. The synthesis of emulsion aggregation toner generally involves emulsion polymerization, such as semi-continuous emulsion polymerization, to form a polymer latex. Techniques for forming polymer by emulsion polymerization are known in the art. In general, initiators, specifically radical initiators, are used to form a latex comprising polymer particles. This use of initiators makes it difficult to include unsaturated groups in the polymer particles of the latex. Thus, the present disclosure describes a process in which unsaturated curable resin is combined with a latex of polymer particles after formation of the latex.

In embodiments, the present disclosure is directed to a method for forming toner comprising: (a) polymerizing monomers to form a latex comprising polymer particles; (b) combining the latex with unsaturated curable resin and homogenizing to form a dispersion comprising the polymer particles and unsaturated curable resin particles; (c) forming aggregates comprising the polymer particles and the unsaturated curable resin particles; and (d) heating the aggregates to form coalesced particles.

In embodiments, the present disclosure is directed to a method for forming toner comprising (a) forming core aggregates comprising polymer particles; (b) mixing the core aggregates with latex polymer particles and unsaturated curable resin particles to form aggregates comprising a shell around the core aggregates: and (c) heating the aggregates comprising the shell to form coalesced particles.

In the processes described herein, photoinitiator may also be included in or on the surface of the coalesced particles. In particular, photoinitiator may be (i) added prior to or during the homogenizing so as to be incorporated into the aggregates and/or (ii) dry mixed with the coalesced particles so as to be incorporated onto the surface of the coalesced particles. The term "photoinitiator" refers, for example, to an initiator that, upon activation by light, such as ultra-violet light, initiates polymerization and/or cross-linking of the unsaturated curable resin particles.

In embodiments, after formation of the latex, the photoinitiator is combined with the unsaturated curable resin and the latex and homogenized to form the dispersion.

In embodiments, the latex is formed by emulsion polymerization of monomers in the presence of the photoinitiator. In this embodiment, the photoinitiator may or may not react with the monomers to become part the polymer formed by the emulsion polymerization. Even where the photoinitiator does not react with the monomers to be included in the polymer itself, it is still incorporated into the polymer particles of the latex.

In embodiments, the present disclosure describes toner in which the toner particles comprise: (i) polymer containing photoinitiator and (ii) unsaturated curable resin. This toner may be formed by the processes described above, specifically by forming the latex by emulsion polymerization of monomers in the presence of a photoinitiator that is incorporated into the polymer.

In embodiments, the present disclosure also describes toner in which the toner particles comprise unsaturated curable resin and, on the surface of the toner particles, photoinitiator. In embodiments, these toner particles comprise a core and a shell, the core comprising polymer and colorant and the shell comprising unsaturated curable resin. This toner may be prepared by forming aggregates comprising latex. polymer particles and unsaturated curable resin particles; heating the aggregates to form coalesced particles, and dry mixing the coalesced particles with photoinitiator to incorporate the initiator onto the surface of the coalesced particles.

The present disclosure also relates to toner formed by the methods described herein. In addition, the present disclosure relates to developer containing the toner described herein, a xerographic device comprising the toner described herein and an image forming processes using the toner described herein. Specifically, the present disclosure relates to an image forming process comprising: (a) charging a latent image carrier having a photoconductive layer; (b) forming an electrostatic latent image on the latent image carrier; (c) developing the electrostatic latent image with toner described herein to form a toner image; (d) transferring the toner image to a receiving material; and (e) activating the photoinitiator to cure the toner.

In embodiments, incorporating radiation-curable initiator into the toner particles lowers the glass transition temperature (Tg) of the particles, relative to toner particles in which this initiator is not included. For example, incorporating radiation-curable initiator into the toner particles can lower the Tg of the particles from about 1 to about 15° C., in embodiments from about 3 to about 10° C., relative to toner particles in which the initiator is not included. This can be advantageous by reducing the minimum fusing temperature of the toner particles, thereby resulting in reduced operating costs. In addition, where the radiation-curable initiator is incorporated into the aggregates, incorporation of this initiator in the aggregates may lower the Tg of the aggregates, relative to aggregates in which this initiator is not included. For example, incorporating radiation-curable initiator into the aggregates can lower the Tg of the aggregates from about 1 to about 15° C., in embodiments from about 3 to about 10° C., relative to aggregates in which the initiator is not included. This can be advantageous by reducing the aggregation and/or coalescence temperatures, thus reducing production costs.

EMBODIMENTS

Forming toner by emulsion aggregation is known in the art. In particular, techniques for forming toner by emulsion aggregation are described in U.S. Published Patent Application No. 2005/0137278 A1, which is herein incorporated by reference in its entirety.

In embodiments, the present disclosure is directed to a method for forming toner comprising (a) forming core aggregates comprising polymer particles; (b) mixing the core aggregates with latex polymer particles and unsaturated curable resin particles to form aggregates comprising a shell around the core aggregates; and (c) heating the aggregates comprising the shell to form coalesced particles. In embodiments, the shell further comprises photoinitiator.

In embodiments, the present disclosure is directed to a method for forming toner comprising: (a) polymerizing monomers to form a latex comprising polymer particles: (b) combining the latex with unsaturated curable resin and homogenizing to form a dispersion comprising the polymer particles and unsaturated curable resin particles; (c) forming aggregates comprising the polymer particles and the unsaturated curable resin particles; and (e) heating the aggregates to form coalesced particles.

The term "homogenizing" refers, for example, to a procedure in which the latex, unsaturated curable resin, optionally photoinitiator and optionally any other components to be included in the dispersion, such as colorant and/or wax, are mixed to form a substantially homogenous dispersion comprising particles of the various components including polymer particles of the latex and unsaturated curable resin particles. The homogenizing can in embodiments be conducted at a mixing rate of at least about 1000 RPM, such as from about 1000 to about 10,000 RPM, or from about 1500 to about 4000 RPM, such as with a polytron.

The dispersion of the present disclosure comprises polymer particles of the latex and unsaturated curable resin particles. In embodiments, the dispersion also comprises photoinitiator. In addition, the dispersion may comprise other components to be incorporated into the toner, such as colorant and/or wax.

The polymer particles may be any polymer suitable for the formation of toner. Illustrative examples of suitable polymers include, for example, polyamides, polyolefins, styrene acrylates, styrene methacrylates, styrene butadienes, polyesters, especially reactive extruded polyesters, crosslinked styrene polymers, epoxies, polyurethanes, vinyl resins, including homopolymers or copolymers of two or more vinyl monomers, and polymeric esterification products of a dicarboxylic acid and a diol comprising a diphenol. Vinyl monomers may include, for example, styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including, for example, methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like; and styrene/butadiene copolymers with a styrene content of from about 60 or about 70 to about 90 or about 95 weight percent.

In an embodiment, the polymer particles comprise a styrene acrylic copolymer. The term "styrene acrylic copolymer" refers, for example, to a copolymer formed from at least styrene monomers and acrylic monomers.

The term "styrene monomer" refers, for example, to styrene per se, as well as styrene containing one or more substitutions, such as 3-chlorostyrene, 2,5-dichlorostyrene, 4-bromostyrene, 4-tert-butylstyrene, 4-methoxystyrene and the like.

The term "acrylic monomer" refers, for example, to acrylic acid, methacrylic acid, and esters of acrylic acid and methacrylic acid. Acrylic monomers include, for example, butyl acrylate, butyl methacrylate, propyl acrylate, propyl methacrylate, ethyl acrylate, ethyl methacrylate, methyl acrylate and methyl methacrylate. In embodiments, the acrylic monomer is n-butyl acrylate.

In embodiments, styrene monomer is used in the copolymer in amounts greater than about 15 weight percent. For example, the amount of styrene monomer is from about 15 to about 90 weight percent, such as from about 60 to about 85 weight percent, based on the total weight of the polymer particles.

In embodiments, acrylic monomer is used in the copolymer in amounts of greater than about 10 weight percent. For example, the amount of acrylic monomer is from about 10 to about 85 weight percent, such as from about 15 to about 40 weight percent, based on the total weight of the polymer particles.

In one embodiment, the monomers forming the copolymer comprise styrene, n-butyl acrylate and 2-carboxyethyl acrylate (β-CEA). In embodiments of the disclosure, the copolymer contains from about 60 to about 80 weight percent styrene, about 15 to about 35 weight percent n-butyl acrylate and about 1 to about 5 weight percent β-CEA.

The unsaturated curable resin is an unsaturated resin that is able to undergo polymerization in the presence of an initiator. In embodiments, the unsaturated resin may be incorporated in the toner particles in amounts of from about 4 to about 60 weight percent, such as from about 5 to about 30 weight percent.

Examples of these resins are unsaturated polyester or polyurethane acrylates, which may be initiated by a radical initiator, and epoxide resins, which may be initiated by a cationic initiator. Examples of commercially available unsaturated curable resins that may be used include, tris (2-hydroxy ethyl) isocyanurate triacrylate (SR 368 Sartomer) from Atofina; ethoxylated pentaerythritol tetraacrylate (Sartomer SR 494) from Atofina; pentaerythritol tetracrylate (Sartomer SR 295); dipentaerythritol pantaacrylate (Sartomer SR 399); chlorinated polyester acrylate (Sartomer CN 2100) from Atofina; amine modified epoxy acrylate (Sartomer CN 2100); aromatic urethane acrylate (Sartomer CN 2901); polyurethane acrylate Laromer LR 8949 from BASF; aromatic urethane triacrylate CN 970 from Atofina; aliphatic diacrylate oligomer CN 132 from Atofina; aliphatic urethane diacrylate CN 981 from Atofina; and aromatic urethane diacrylate CN976 from Atofina. Other unsaturated curable resins that may be used are described in U.S. Published Patent Application No. 2005/0137278 A1, which is herein incorporated by reference in its entirety. One exemplary suitable unsaturated curable resin is polyurethane acrylate Laromer™ LR 8949 from BASF.

In the present disclosure, photoinitiators, for example UV-activated photoinitiators, may be used to initiate polymerization of the unsaturated curable resin, specifically cationic or radical polymerization. Suitable photoinitiators that may be employed include, for example, hydroxyalkylphenylalkylones, such a 2-hydroxy-2-methyl-1-phenyl-1-propanone available from Ciba-Geigy under the grade designation Darocur 1173; and 1-hydroxycyclohexylphenyl ketone; 2-benzyl-2-dimethylamino-1-(4-morpholinophenyl)-butan-1-one; 2,2-dimethoxy-2-phenylacetophenone; 2-methyl-1-[4-(methylthio)phenyl]-2-(4-morpholinyl)-1-propanone available from Ciba-Geigy under the grade designation Irgacure® 184, 369, 651, and 907 respectively. Particularly suitable photoinitiators include Lucrin™ TPO (2,4,6-trimethylbenzoyldiphenylphosphine oxide) or Lucrin™ TPO-L (ethyl-2,4,6-trimethylbenzoyldiphenylphosphinate) from BASF.

The photoinitiator may be incorporated into the toner particles and/or onto the surface of the particles in amounts of from about 0.05 wt. % to about 10 wt. %, in embodiments from about 0.25 wt. % to about 6 wt. %, relative to the total weight of the toner particles.

In embodiments, the photoinitiator is added to the dry toner particles as an external additive. In this case, a solid photoinitiator, such as Lucrin™ TPO, may be pulverized to the desired size (such as from about 10 to about 200 nanometers, or from about 20 to about 150 nanometers, although other sizes can be used) and then dry blended with toner particles to form a surface layer of initiator on the toner particles. This technique would be especially useful if the unsaturated resin within the toner was added as a "shell" around the toner aggregates prior to coalescence. Therefore the initiator and unsaturated resin would be in close proximity during curing.

In embodiments, the photoinitiator is added during the homogenization. Emulsion aggregation (EA) components are normally added together at the beginning of the aggregation/coalescence (A/C) process under high shear just prior to addition of the aggregating solution. As shown in Examples 2 and 3 below, photoinitiator can be blended in under high shear with other toner components including the latex, unsaturated curable resin, optionally colorant, and optionally wax, followed by the addition of aggregating agent to facilitate aggregation of the toner components. The A/C process is then carried out to form-coalesced particles containing photoinitiator and unsaturated resin.

In embodiments, the photoinitiator is incorporated into the polymer particles of the latex. To incorporate the initiator into the polymer particles, an emulsion polymerization process may be conducted in which the initiator is dissolved into the monomers, which are then emulsified in water to form an aqueous monomer/initiator emulsion. This solution may be used as the monomer feed in a semi-continuous emulsion polymerization to ultimately form latex particles containing initiator. The resulting latex particles can be used in the A/C process to form toner particles containing initiator, as in Examples 4 and 5 below.

In an embodiment, the photoinitiator is not only incorporated into the polymer particles of the latex, it is chemically incorporated into the polymer itself. By incorporating the photoinitiator onto the polymer chain, upon exposure to radiation activating the initiator, free radicals may be generated on the backbone of the toner resin, which may add the unsaturated curable resin via radical polymerization resulting in a dramatic increase in resin molecular weight. This may be a much more efficient way to crosslink the toner resin during curing compared to having the photoinitiator as a free floating species within the toner.

Where the photoinitiator is incorporated into the polymer chain, the polymer may contain from about 0.05 to about 10 weight percent, in embodiments from about 0.25 to about 6 weight percent, photoinitiator.

To incorporate the photoinitiator into the polymer, photoinitiator that polymerizes with monomers being using to form the latex may be used. In an embodiment, the radiation activated initiator is a modified version of a commercially available product from Ciba called Irgacure 2959 (2-hydroxy-4'-hydroxyethoxy-2-methylpropiophenone) shown below.

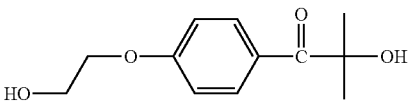

Irgacure 2959 photoinitiator (Ciba)

By utilizing the hydroxyl group on Irgacure 2959, one can react this compound with methacryloyl chloride to form the following compound:

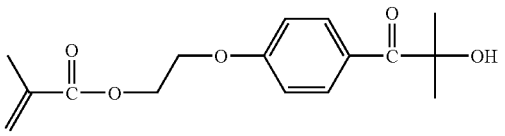

(2-[p-(2-hydroxy-2-methylpropiophenone)]-ethyleneglycolmethacrylate), which is referred to herein as HMEM.

This compound can be incorporated into the latex polymer via emulsion polymerization. Alternatively, any other photoinitiator that can be incorporated into the latex polymer by emulsion polymerization may be used. The latex polymer, with incorporated initiator, can then be used to synthesize curable emulsion aggregation toner by aggregating this latex polymer with an unsaturated curable resin, such as Laromer™ LR 8949. Upon fusing this toner onto a substrate and exposing the image to radiation at elevated temperature, free radicals should be generated on the latex backbone and cause radical polymerization between the latex and the unsaturated resin, thus forming a robust image.

Colorants that may be included include pigments, dyes, mixtures of pigment and dye, mixtures of pigments, mixtures of dyes, mixtures of pigments and dyes, and the like. The colorant may be present in an effective amount of, for example, from about 1 to about 35 percent by weight of toner, in embodiments from about 1 to about 15 percent by weight of the toner, or from about 3 to about 10 percent by weight of the toner.

Illustrative examples of colorants, such as pigments, that may be used in the processes of the present disclosure include, carbon black, such as REGAL 330.R™; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. Colored pigments or dyes, including cyan, magenta, yellow, red, green, brown, blue and/or mixtures thereof, may also be used. Generally, cyan, magenta, or yellow pigments or dyes, or mixtures thereof, are used. The pigment or pigments are generally used as water based pigment dispersions.

Specific examples of pigments include, SUNSPERSE 6000™, FLEXIVERSE™ and AQUATONE™ water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments in the present disclosure.

Waxes that may be selected include waxes with, for example, a weight average molecular weight of from about 500 to about 20,000, in embodiments from about 500 to about 10,000. Waxes that may be used include, for example, polyolefins such as polyethylene, polypropylene, and polybutene waxes; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsh wax;

ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate, as well as mixtures of waxes. These and/or other waxes may be included in amounts of from about 1 to about 25 wt. % of the toner weight; and in embodiments from about 10 to about 20 wt. % or from about 3 to about 5 wt. % of the toner weight. Waxes may be included as, for example, fuser roll release agents.

Other toner additives may be included without limitation, for example, charge enhancing additives.

To form the toner aggregates, a flocculant may be added to the dispersion. Flocculants may be used in effective amounts of, for example, from about 0.01 percent to about 10 percent by weight of the toner, in embodiments from about 0.1 percent to about 5 percent by weight of the toner. Flocculants that may be used include, for example, polyaluminum chloride (PAC), polyaluminum sulfo silicate, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like. In these materials, the alkyl groups can have, for example, from 1 to about 20 or about 30 or more carbon atoms.

To form the toner aggregates, the dispersion is generally heated to a temperature below the glass transition temperature (Tg), such as to a temperature from about 30 to about 60° C., in embodiments to a temperature of from 45 to about 55° C.

In embodiments, the aggregates are formed by forming core particles comprising the polymer particles, the unsaturated curable resin particles and other toner components, such as colorant and wax; adding additional polymer particles to the dispersion; and forming a shell around the core particles, the shell comprising the additional polymer particles. The additional polymer particles can be in the form of a latex. In embodiments, the shell thickness is from about 200 to about 400 nm.

Once toner sized aggregates are formed, the aggregates are heated to coalesce the particles. This is generally achieved by heating the aggregates to a temperature above the glass transition temperature (Tg) of the aggregates, such as to a temperature from about 70 to about 150° C., in embodiments to a temperature of from 80 to about 140° C.

The toner particles described herein are optionally blended with external additives following formation. Any suitable surface additives may be used. Exemplary external additives include one or more of $SiO_2$, metal oxides such as, for example, $TiO_2$ and aluminum oxide, and a lubricating agent such as, for example, a metal salt of a fatty acid (such as zinc stearate (ZnSt), calcium stearate) or long chain alcohols such as UNILIN 700. In general, silica is applied to the toner surface for toner flow, tribo enhancement, admix control, improved development and transfer stability and higher toner blocking temperature. $TiO_2$ can be present, for example, to provide relative humidity (RH) stability, tribo control and development and transfer stability. Zinc stearate can also be used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Desirable in an embodiment is a commercially available zinc stearate known as Zinc Stearate L, obtained from Ferro Corporation. The external surface additives can be used with or without a coating.

The toners may contain, for example, from about 0.5 to about 10 weight percent titania, in embodiments from about 1 to about 5 weight percent titania (size of from about 10 nm to about 50 nm, in embodiments from about 20 nm to about 45 nm, such as about 40 nm), from about 0.5 to about 10 weight percent silica, in embodiments from about 1 to about 5 weight percent silica (size of from about 10 nm to about 50 nm, in embodiments from about 20 nm to about 45 nm, or about 40 nm), from about 0.5 to about 10 weight percent sol-gel silica, in embodiments from about 1 to about 5 weight percent sol-gel silica, and/or from about 0.1 to about 4 weight percent zinc stearate, in embodiments from about 0.5 to about 3 weight percent zinc stearate.

The toner compositions can optionally be formulated into a developer composition by mixing the toner particles with carrier particles. Illustrative examples of carrier particles that can be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating. In one embodiment, the carrier particles are comprised of a core with coating thereover generated from a mixture of polymers that are not in close proximity thereto in the triboelectric series. The coating may be comprised of fluoropolymers, such as polyvinylidene fluoride resins, terpolymers of styrene, methyl methacrylate, and a silane, such as triethoxy silane, tetrafluoroethylenes, other known coatings and the like. For example, coating containing polyvinylidenefluoride, available, for example, as Kynar 301F™, and/or polymethylmethacrylate may be used. In embodiments, polyvinylidenefluoride and polymethylmethacrylate may be mixed in proportions of from about 30 to about 70 wt. % to about 70 to about 30 wt. %, in embodiments from about 40 to about 60 wt. % to about 60 to about 40 wt. %.

An exemplary suitable carrier is a steel core, for example of about 25 to about 100 μm in size, in embodiments from about 50 to about 75 μm in size, coated with about 0.5% to about 10% by weight, in embodiments from about 0.7% to about 5% by weight, such as about 1% by weight, of a conductive polymer mixture comprised of, for example, methylacrylate and carbon black using the process described in U.S. Pat. Nos. 5,236,629 and 5,330,874.

The carrier particles can be mixed with the toner particles in various suitable combinations. The concentrations are usually about 1% to about 20% by weight of toner and about 80% to about 99% by weight of carrier. However, different toner and carrier percentages may be used to achieve a developer composition with desired characteristics.

The toners can be used in known electrostatographic imaging methods. Thus for example, the toners or developers can be charged, for example, triboelectrically, and applied to an oppositely charged latent image on an imaging member such as a photoreceptor or ionographic receiver. The resultant toner image can then be transferred, either directly or via an intermediate transport member, to an image receiving substrate such as paper or a transparency sheet. The toner image can then be fused to the image receiving substrate by application of heat and/or pressure, for example with a heated fuser roll. As part of the fusing process, the unsaturated curable resin may be cured by, for example, activating the photoinitiator.

EXAMPLES

The following examples illustrate specific embodiments of the present disclosure. The appropriate reagents, component ratio/concentrations may be adjusted as necessary to achieve specific product characteristics. All parts and percentages are by weight unless otherwise indicated.

Preparation of Latex A

A latex emulsion comprised of polymer particles generated from the emulsion polymerization of styrene, n-butyl acrylate and beta-CEA was prepared as follows.

A surfactant solution of 605 grams Dowfax 2A1 (anionic emulsifier) and 387 kg de-ionized water was prepared by mixing for 10 minutes in a stainless steel holding tank. The holding tank was then purged with nitrogen for 5 minutes before transferring into the reactor. The reactor was then continuously purged with nitrogen while being stirred at 100 rpm. The reactor was then heated up to 80° C. at a controlled rate, and held there. Separately, 6.1 kg of ammonium persulfate initiator was dissolved in 30.2 kg of de-ionized water.

Separately, the monomer emulsion was prepared in the following manner. 311.4 kg of styrene, 95.6 kg of butyl acrylate and 12.21 kg of β-CEA, 2.88 kg of 1-dodecanethiol, 1.42 kg of 1,10-decanediol diacrylate (ADOD), 8.04 kg of Dowfax 2A1(anionic surfactant), and 193 kg of deionized water were mixed to form an emulsion. 1% of the above emulsion was then slowly fed into the reactor containing the aqueous surfactant phase at 80° C. to form the "seeds" while being purged with nitrogen. The initiator solution was then slowly charged into the reactor and after 10 minutes the rest of the emulsion was continuously fed in using a metering pump at a rate of 0.5%/min. Once all the monomer emulsion was charged into the main reactor, the temperature was held at 80° C. for an additional 2 hours to complete the reaction. Full cooling was then applied and the reactor temperature was reduced to 35° C. The product was collected into a holding tank. After drying the latex, the molecular properties were Mw=35,419, Mn=11, 354 and the onset Tg was 51.0° C.

Preparation of Latex B

A latex emulsion comprised of polymer particles generated from the emulsion polymerization of styrene, n-butyl acrylate and beta-CEA and containing 0.7% Lucrin™ TPO photoinitiator was prepared as follows.

A surfactant solution of 0.8 grams Dowfax 2A1 (anionic surfactant) and 514 grams de-ionized water was prepared by mixing for 10 minutes in a stainless steel holding tank. The holding tank was then purged with nitrogen for 5 minutes before transferring into the 2 liter Buchi reactor. The reactor was then continuously purged with nitrogen while being stirred at 300 rpm. The reactor was then heated up to 76° C. at a controlled rate, and held there. Separately, 8.1 grams of ammonium persulfate initiator was dissolved in 45 grams of de-ionized water.

Separately, the monomer emulsion was prepared in the following manner. 413.1 grams of styrene,. 126.9 grams of n-butyl acrylate and 16.2 grams of β-CEA, 3.78 grams of 1-dodecanethiol, 1.89 grams of ADOD, 3.85 grams Lucirin™ TPO photoinitiator, 10.69 grams of Dowfax 2A1, and 257 grams of deionized water were mixed to form an emulsion. 1% of the above emulsion was then slowly fed into the reactor containing the aqueous surfactant phase at 76° C. to form the "seeds" while being purged with nitrogen. The initiator solution was then slowly charged into the reactor and after 10 minutes the rest of the emulsion was continuously fed in using a metering pump at a rate of 4 grams/minute. After 100 minutes, in which half of the monomer emulsion has been added, an additional 4.54 grams of 1-dodecanethiol was added to the emulsion mixture, and the emulsion was continued to be added into the Buchi at a rate of 4 grams/minute. Also at this time, the Buchi stirrer was increased in speed to 350 RPM. Once all the monomer emulsion was charged into the main reactor, the temperature was held at 76° C. for an additional 2 hours to complete the reaction. Full cooling was then applied and the reactor temperature was reduced to 23° C. The product was collected into a holding tank. After drying the latex, the molecular properties were Mw=39,000, Mn=11, 400 and the onset Tg was 47.41° C. The latex particle size as measured on the Nicomp Submicron Particle Sizer was 215 nanometers.

Preparation of Latex C

A latex emulsion comprised of polymer particles generated from the emulsion polymerization of styrene, n-butyl acrylate and beta-CEA and containing 0.7% Lucrin™ TPO-L photoinitiator was prepared as follows.

A surfactant solution of 0.8 grams Dowfax 2A1 (anionic surfactant) and 514 grams de-ionized water was prepared by mixing for 10 minutes in a stainless steel holding tank. The holding tank was then purged with nitrogen for 5 minutes before transferring into the 2 liter Buchi reactor. The reactor was then continuously purged with nitrogen while being stirred at 300 rpm. The reactor was then heated up to 76° C. at a controlled rate, and held there. Separately, 8.1 grams of ammonium persulfate initiator was dissolved in 45 grams of de-ionized water.

Separately, the monomer emulsion was prepared in the following manner. 413.1 grams of styrene, 126.9 grams of n-butyl acrylate and 16.2 grams of β-CEA, 3.78 grams of 1-dodecanethiol, 1.89 grams of ADOD, 3.85 grams Lucirin™ TPO-L photoinitiator, 10.69 grams of Dowfax 2A1, and 257 grams of deionized water were mixed to form an emulsion. 1% of the above emulsion was then slowly fed into the reactor containing the aqueous surfactant phase at 76° C. to form the "seeds" while being purged with nitrogen. The initiator solution was then slowly charged into the reactor and after 10 minutes the rest of the emulsion was continuously fed in using a metering pump at a rate of 4 grams/minute. After 100 minutes, in which half of the monomer emulsion has been added, an additional 4.54 grams of 1-dodecanethiol was added to the emulsion mixture, and the emulsion was continued to be added into the Buchi at a rate of 4 grams/minute. Also at this time, the Buchi stirrer was increased in speed to 350 RPM. Once all the monomer emulsion was charged into the main reactor, the temperature was held at 76° C. for an additional 2 hours to complete the reaction. Full cooling was then applied and the reactor temperature was reduced to 23° C. The product was collected into a holding tank. After drying the latex, the molecular properties were Mw=33,494, Mn=10,470 and the onset Tg was 46.12° C. The latex particle size as measured on the Nicomp Submicron Particle Sizer was 217 nanometers.

TABLE 1

Summary of latexes.

| Latex ID | Styrene | Photoinitiator | Mw (kg/mol) | Mn (kg/mol) | Tg onset |
|---|---|---|---|---|---|
| A | 76.5 | 0 | 35.4 | 11.4 | 51.0° C. |
| B | 76.5 | 0.7% Lucrin ™ TPO | 39 | 11.4 | 47.4° C. |
| C | 76.5 | 0.7% Lucrin ™ TPO-L | 33.5 | 10.5 | 46.1° C. |

Example 1

Preparation of EA Toner Particles Containing 10% UV Curable Resin, 0% Photoinitiator Into a 2 liter glass reactor equipped with an overhead stirrer and heating mantle was dispersed 241.1 grams of Latex A having a 41 percent solids content, 41.55 grams Laromer™ 8949 (unsaturated curable resin) dispersion having a solids content of 48.13 percent, 60.89 grams of Polywax 725 dispersion having a solids content of 30.30 percent, 64.1 grams of a Blue Pigment PB15:3 dispersion having a solids content of 17 percent, into 617.6 grams of water with high shear stirring at from 2000 to 2500 RPM by means of a polytron.

To this mixture was added 36 grams of a flocculant solution of 10 weight percent poly(aluminiumchloride) (PAC) and 90 wt. % 0.02M $HNO_3$ solution. The PAC solution was added drop-wise at low rpm and, as the viscosity of the pigmented latex mixture increases, the rpm of the polytron probe also increases to 5,000 rpm for a period of 2 minutes. The slurry was heated at a controlled rate of 0.5° C./minute up to approximately 46° C. and held at this temperature or slightly higher to grow the particles to approximately 5.0 microns. Once the average particle size of 5.0 microns was achieved, 138.2 grams of Latex A was then introduced into the reactor while stirring. After an additional 30 minutes to 1 hour the particle size measured was 5.7 microns with a GSD of 1.20. The pH of the resulting mixture was then adjusted from about 2.0 to about 7.0 with aqueous base solution of 4 percent sodium hydroxide and the mixture was stirred for an additional 15 minutes. Subsequently, the resulting mixture was heated to 93° C. at 1.0° C. per minute. The pH was then reduced to 4.0 using a 2.5 percent Nitric acid solution. The resultant mixture was then allowed to coalesce for 5 hours at a temperature of 93° C. The particles were washed 6 times, where the first wash was conducted at pH of 10 at 63° C., followed by 3 washes with deionized water at room temperature (about 20° C. to about 25° C.), one wash carried out at a pH of 4.0 at 40° C., and finally the last wash with deionized water at room temperature. The final average particle size of the dried particles was 5.7 microns with GSD=1.22. The toner Tg(onset) was 48.0° C. and the Tg(midpoint) was 52.6° C.

Example 2

Preparation of EA Toner Particles Containing 10% UV Curable Resin, 3.6% Photoinitiator Into a 2 liter glass reactor equipped with an overhead stirrer and heating mantle was dispersed 241.1 grams of Latex A having a 41 percent solids content, 41.55 grams Laromer™ 8949 (unsaturated curable resin) dispersion having a solids content of 48.13 percent, 60.89 grams of Polywax 725 dispersion having a solids content of 30.30 percent, 64.1 grams of a Blue Pigment PB15:3 dispersion having a solids content of 17 percent, and 7.2 grams solid Lucirin™ TPO photoinitiator into 617.6 grams of water with high shear stirring at from 2000 to 2500 RPM by means of a polytron. The resulting photoinitiator concentration (Lucirin™ TPO) was 36 weight percent by weight of Laromer™ 8949 (unsaturated curable resin).

To this mixture was added 36 grams of a flocculant solution of 10 weight percent PAC and 90 wt. % 0.02M $HNO_3$ solution. The PAC solution was added drop-wise at low rpm and, as the viscosity of the pigmented latex mixture increases, the rpm of the polytron probe also increases to 5,000 rpm for a period of 2 minutes. The slurry was heated at a controlled rate of 0.5° C./minute up to approximately 46° C. and held at this temperature or slightly higher to grow the particles to approximately 5.0 microns. Once the average particle size of 5.0 microns was achieved, 138.2 grams of Latex A was then introduced into the reactor while stirring. After an additional 30 minutes to 1 hour the particle size measured was 6.2 microns with a GSD of 1.20. The pH of the resulting mixture was then adjusted from 2.0 to 7.0 with aqueous base solution of 4 percent sodium hydroxide and the mixture was stirred for an additional 15 minutes. Subsequently, the resulting mixture was heated to 93° C. at 1.0° C. per minute. The pH was then reduced to 4.0 using a 2.5 percent Nitric acid solution. The resultant mixture was then allowed to coalesce for 5 hours at a temperature of 93° C. The particles were washed 6 times, where the first wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 6.3 microns with GSD=1.22. The toner Tg(onset) was 42.3° C. and the Tg(midpoint) was 48.5° C.

Example 3

Preparation of EA Toner Particles Containing 10% UV Curable Resin, 0.5% Photoinitiator Into a 2 liter glass reactor equipped with an overhead stirrer and heating mantle was dispersed 237.4 grams of Latex A having a 41 percent solids content, 41.55 grams Laromer™ 8949 (unsaturated curable resin) dispersion having a solids content of 48.13 percent, 60.89 grams of Polywax 725 dispersion having a solids content of 30.30 percent, 64.1 grams of a Blue Pigment PB15:3 dispersion having a solids content of 17 percent, and 1 gram solid Lucirin™ TPO photoinitiator into 617.6 grams of water with high shear stirring at from 2000 to 2506 RPM by means of a polytron. The resulting photoinitiator concentration (Lucirin™ TPO) was 5 weight percent by weight of Laromer™ 8949 (unsaturated curable resin).

To this mixture was added 36 grams of a flocculant solution of 10 weight percent PAC and 90 wt. % 0.02M $HNO_3$ solution. The PAC solution was added drop-wise at low rpm and, as the viscosity of the pigmented latex mixture increases, the rpm of the polytron probe also increases to 5,000 rpm for a period of 2 minutes. The slurry was heated at a controlled rate of 0.5° C./minute up to approximately 46° C. and held at this temperature or slightly higher to grow the particles to approximately 5.0 microns. Once the average particle size of 5.0 microns was achieved, 138.2 grams of Latex A was then introduced into the reactor while stirring. After an additional 30 minutes to 1 hour the particle size measured was 5.8 microns with a GSD of 1.23. The pH of the resulting mixture was then adjusted from 2.0 to 7.0 with aqueous base solution of 4 percent sodium hydroxide and the mixture was stirred for an additional 15 minutes. Subsequently, the resulting mixture was heated to 95° C. at 1.0° C. per minute. The pH was then reduced to 5.0 using a 2.5 percent Nitric acid solution. The resultant mixture was then allowed to coalesce for 5 hours at a temperature of 95° C. The particles were washed 6 times, where the first wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.8 microns with GSD=1.23. The toner Tg(onset) was 46.9° C. and the Tg(midpoint) was 51.5° C.

Example 4

Preparation of EA Toner Particles from Latex B Containing 10% UV Curable Resin Into a 2 liter glass reactor equipped with an overhead stirrer and heating mantle was dispersed 236.9 grams of Latex B having a 40.52 percent solids content, 41.55 grams Laromer™ 8949 (unsaturated curable resin) dispersion having a solids content of 48.13 percent, 60.16 grams of Polywax 725 dispersion having a solids content of 30.67 percent, 64.1 grams of a Blue Pigment PB15:3 dispersion having a solids content of 17 percent into 613.1 grams of water with high shear stirring at from 2000 to 2500 RPM by means of a polytron. The resulting photoinitiator concentration contained in the latex (Lucirin™ TPO) was 5 weight percent by weight of Laromer™ 8949 (unsaturated curable resin).

To this mixture was added 36 grams of a flocculant solution of 10 weight percent PAC and 90 wt. % 0.02M $HNO_3$ solution. The PAC solution was added drop-wise at low rpm and, as the viscosity of the pigmented latex mixture increases, the rpm of the polytron probe also increases to 5,000 rpm for a period of 2 minutes. The slurry was heated at a controlled rate of 0.5° C./minute up to approximately 46° C. and held at this temperature or slightly higher to grow the particles to approximately 5.0 microns. Once the average particle size of 5.0 microns was achieved, 138.2 grams of Latex B was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and the mixture was stirred for an additional 15 minutes. Subsequently, the resulting mixture was heated to 80° C. at 1.0° C. per minute. The pH was then reduced to 6.0 using a 2.5 percent Nitric acid solution. The resultant mixture was then allowed to coalesce for 10 hours at a temperature of 80° C. The particles were washed 6 times, where the first wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21. The toner Tg(onset) was 45.0° C. and the Tg(midpoint) was 50.2 ° C.

Example 5

Preparation of EA Toner Particles from Latex C Containing 10% UV Curable Resin Into a 2 liter glass reactor equipped with an overhead stirrer and heating mantle was dispersed 241.1 grams of Latex C having a 40.76 percent solids content, 41.55 grams Laromer™ 8949 (unsaturated curable resin) dispersion having a solids content of 48.13 percent, 60.16 grams of Polywax 725 dispersion having a solids content of 30.67 percent, 64.1 grams of a Blue Pigment PB15:3 dispersion having a solids content of 17 percent into 614.6 grams of water with high shear stirring at from 2000 to 2500 RPM by means of a polytron. The resulting photoinitiator concentration contained in the latex (Lucirin™ TPO-L) was 5 weight percent by weight of Laromer™ 8949 (unsaturated curable resin).

To this mixture was added 36 grams of a flocculant solution of 10 weight percent PAC and 90 wt. % 0.02M $HNO_3$ solution. The PAC solution was added drop-wise at low rpm and, as the viscosity of the pigmented latex mixture increases, the rpm of the polytron probe also increases to 5,000 rpm for a period of 2 minutes. The slurry was heated at a controlled rate of 0.5° C./minute up to approximately 46° C. and held at this temperature or slightly higher to grow the particles to approximately 5.0 microns. Once the average particle size of 5.0 microns was achieved, 138.2 grams of Latex C was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and the mixture was stirred for an additional 15 minutes. Subsequently, the resulting mixture was heated to 80° C. at 1.0° C. per minute. The pH was then reduced to 6.0 using a 2.5 percent Nitric acid solution. The resultant mixture was then allowed to coalesce for 10 hours at a temperature of 80° C. The particles were washed 6 times, where the first wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21. The toner Tg(onset) was 44.3° C. and the Tg(midpoint) was 48.0° C.

TABLE 2

Summary of Toners.

| Toner ID | Laromer LR 8949 | Pigment | Wax | Photoinitiator | D50 | GSD | Toner Tg(onset) |
|---|---|---|---|---|---|---|---|
| Example 1 | 10 | 5% Cyan | 9% PW725 | 0 | 5.7 | 1.22 | 48.0° C. |
| Example 2 | 10 | 5% Cyan | 9% PW725 | 3.6% TPO | 6.3 | 1.22 | 42.3° C. |
| Example 3 | 10 | 5% Cyan | 9% PW725 | 0.5% TPO | 5.8 | 1.23 | 46.9° C. |
| Example 4 | 10 | 5% Cyan | 9% PW725 | 0.5% TPO* | 5.8 | 1.21 | 45.0° C. |
| Example 5 | 10 | 5% Cyan | 9% PW725 | 0.5% TPO-L* | 5.8 | 1.21 | 44.3° C. |

*Initiator incorporated in the latex resin during emulsion polymerization

Example 6

Preparation of EA Toner Particles Containing 10% UV Curable Resin, 0.5% Photoinitiator Incorporated into the Latex Polymer Preparation of Polymerizable Photoinitiator (HMEM)

The modified version of Irgacure 2959 was prepared by a Schotten-Baumann reaction, slightly modified from that outlined in Guo, X. et.al., *Macromolecules,* 1999, 32, 6043-6046, as illustrated below.

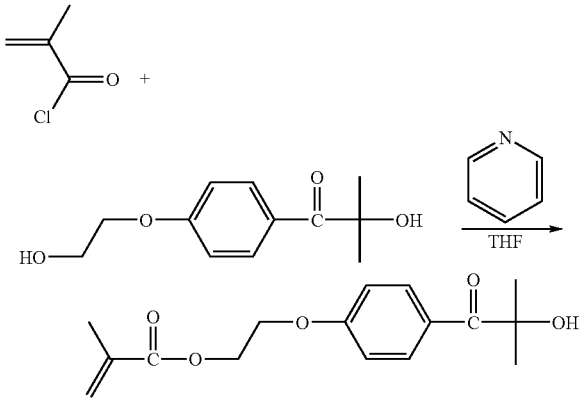

The reaction involves 23.78 grams of 2-hydroxy-4'-hydroxyethoxy-2-methylpropiophenone and 11.86 grams of methacryloyl chloride in 200 mL anhydrous tetrahydrofuran using 20 mL distilled pyridine as base. The resulting product was washed once with 0.4M hydrochloric acid and three times with a saturated sodium bicarbonate solution. Further purification was achieved through chromatography on silica gel using 50/50 acetone/hexanes as the eluent. The overall yield was 20%.

Preparation of Latex D containing HMEM Photoinitiator

A latex emulsion comprised of polymer particles generated from the emulsion polymerization of styrene, n-butyl acrylate,. HMEM photoinitiator, and beta-CEA was prepared as follows.

A surfactant solution of 0.8 grams Dowfax 2A1 (anionic emulsifier) and 514 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 rpm. The reactor was then heated up to 76° C. at a controlled rate, and held there. Separately, 8.1 grams of ammonium persulfate initiator was dissolved in 45 grams of de-ionized water.

Separately the monomer emulsion was prepared in the following manner. 376.65 grams of styrene, 109.35 grams of butyl acrylate and 14.46 grams of β-CEA, 3.4 grams of 1-dodecanethiol, 1.7 grams of ADOD, 9.6 grams of Dowfax 2A1 (anionic surfactant), and 230 grams of deionized water were mixed to form a monomer emulsion. 1% of the above monomer emulsion was then slowly fed into the reactor containing the aqueous surfactant phase at 76° C. to form the "seeds" while being purged with nitrogen. The initiator solution was then slowly charged into the reactor and after 10 minutes the monomer emulsion was continuously fed in using a metering pump at a rate of 4 grams/min. After 100 minutes of emulsion feed, 3.63 grams of 1-dodecanethiol was added into the monomer emulsion. After the monomer emulsion was completely added, a separate monomer emulsion was added into the reactor at a rate of 4 grams/min. The second monomer emulsion contains 41.85 grams styrene, 12.15 grams of butyl acrylate and 1.74 grams of β-CEA, 1.446 grams of 1-dodecanethiol, 0.189 grams of ADOD, 3.85 grams HMEM photoinitiator, 1.068 grams of Dowfax 2A1, and 25.6 grams deionized water. Once all the monomer emulsion was charged into the main reactor, the temperature was held at 76° C. for an additional 2 hours to complete the reaction. Full cooling was then applied and the reactor temperature was reduced to 35° C. The product was collected into a holding tank. After drying the latex, the molecular properties were Mw=37,300, Mn=11,100 and the onset Tg was 49.5° C.

TABLE 3

Summary of latex.

| Latex ID | Styrene | Photo-initiator | Mw (kg/mol) | Mn (kg/mol) | Tg onset |
|---|---|---|---|---|---|
| Latex D | 76.5 | 0.7% HMEM | 37.3 | 11.1 | 49.5° C. |

Preparation of EA Toner Particles

Into a 2 liter glass reactor equipped with an overhead stirrer and heating mantle was dispersed 241.1 grams of Latex D having a 39.88 percent solids content, 33.24 grams Laromer™ 8949 (unsaturated curable resin) dispersion having a solids content of 48.13 percent, 48.71 grams of Polywax 725 dispersion having a solids content of 30.30 percent, and 51.3 grams of a Blue Pigment PB15:3 dispersion having a solids content of 17 percent, into 487 grams of de-ionized water with high shear stirring at from 2000 to 2500 RPM by means of a polytron.

To this mixture was added 28.8 grams of a flocculant solution of 10 weight percent PAC and 90 wt. % 0.02M $HNO_3$ solution. The PAC solution was added drop-wise at low rpm and, as the viscosity of the pigmented latex mixture increases, the rpm of the polytron probe also increases to 5,000 rpm for a period of 2 minutes. The slurry was heated at a controlled rate of 0.5° C./minute up to approximately 46° C. and held at this temperature or slightly higher to grow the particles to approximately 5.0 microns. Once the average particle size of 5.0 microns was achieved, 112.3 grams of Latex D was then introduced into the reactor while stirring. The resulting photoinitiator concentration (HMEM incorporated into the latex) was 5 weight percent by weight of Laromer™ 8949 (unsaturated curable resin). After an additional 30 minutes to 1 hour the particle size measured was 5.6 microns with a GSD of 1.22. The pH of the resulting mixture was then adjusted from 2.0 to 7.0 with aqueous base solution of 4 percent sodium hydroxide and the mixture was stirred for an additional 15 minutes. Subsequently, the resulting mixture was heated to 80° C. at 1.0° C. per minute. The pH was then reduced to 6.0 using a 2.5 percent Nitric acid solution. The resultant mixture was then allowed to coalesce for 10 hours at a temperature of 80° C. The particles were washed 6 times, where the first wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.6 microns with GSD=1.23. The toner Tg(onset) was 47.3° C. and the Tg(midpoint) was 52.5° C.

TABLE 4

Summary of toner.

| Toner ID | Laromer LR 8949 | Pigment | Wax | Photoinitiator | D50 | GSD | Toner Tg(onset) |
|---|---|---|---|---|---|---|---|
| Example 6 | 10 | 5% Cyan | 9% PW725 | 0.7% HMEM* | 5.6 | 1.23 | 47.3° C. |

*Initiator incorporated chemically into the latex resin

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner composition comprising toner particles, the toner particles comprising: (i) a polymer comprising a photoinitiator that is incorporated onto a polymer chain of the polymer and (ii) an unsaturated curable resin.

2. The toner composition according to claim 1, wherein the photoinitiator is activated by ultra-violet light.

3. The toner composition according to claim 1, wherein the photoinitiator that is incorporated onto a polymer chain of the polymer is

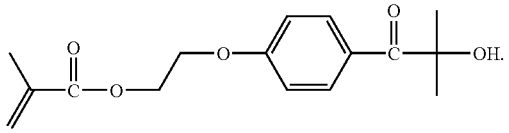

4. The toner composition according to claim 1, wherein the unsaturated curable resin comprises an unsaturated polyurethane acrylate.

5. The toner composition according to claim 1, wherein the toner particles further comprise at least one of colorant or wax.

6. The toner composition according to claim 1, wherein the polymer is a styrene acrylic copolymer.

7. The toner composition according to claim 1, wherein the toner particles comprise from about 5 to about 30 weight percent unsaturated curable resin and from about 70 to about 95 weight percent polymer comprising photoinitiator, the polymer comprising the photoinitiator comprising from about 0.25 to about 6 weight percent photoinitiator.

8. The toner composition according to claim 1, wherein the polymer is formed by emulsion polymerization of monomers in the presence of the photoinitiator, wherein the photoinitiator reacts with the monomers to form the polymer.

9. An image forming process comprising: (a) charging a latent image carrier having a photoconductive layer; (b) forming an electrostatic latent image on the latent image carrier; (c) developing the electrostatic latent image with a toner composition according to claim 1, to form a toner image; (d) transferring the toner image to a receiving material; and (e) activating the photoinitiator to cure the toner particles.

10. A xerographic device comprising an image forming member and a housing containing toner according to claim 1.

11. A process comprising:

(a) forming core aggregates comprising polymer particles;

(b) mixing the core aggregates with latex polymer particles and unsaturated curable resin particles to form aggregates comprising a shell around the core aggregates, the shell comprising the latex polymer particles including a photoinitiator that is incorporated onto a polymer chain of the polymer and the unsaturated curable resin particles; and (c) heating the aggregates comprising the shell to form coalesced particles.

12. The process according to claim 11, wherein the latex polymer particles are formed by emulsion polymerization of monomers in the presence of the photoinitiator.

13. The process according to claim 11, wherein the photoinitiator reacts with the monomers to form a polymer containing the photoinitiator.

14. Toner formed by the process of claim 11.

* * * * *